US012110784B2

(12) United States Patent
Semel

(10) Patent No.: US 12,110,784 B2
(45) Date of Patent: Oct. 8, 2024

(54) SOIL WORKING DEVICE AND METHOD FOR CREATING A SUBSTANTIALLY VERTICAL HOLE IN THE GROUND

(71) Applicant: BAUER Maschinen GmbH, Schrobenhausen (DE)

(72) Inventor: Matthias Semel, Pfaffenhofen (DE)

(73) Assignee: BAUER Maschinen GmbH, Schrobenhausen (DE)

( * ) Notice: Subject to any disclaimer, the term of this patent is extended or adjusted under 35 U.S.C. 154(b) by 0 days.

(21) Appl. No.: 17/905,807

(22) PCT Filed: Jan. 27, 2021

(86) PCT No.: PCT/EP2021/051789
§ 371 (c)(1),
(2) Date: Sep. 7, 2022

(87) PCT Pub. No.: WO2021/180392
PCT Pub. Date: Sep. 16, 2021

(65) Prior Publication Data

US 2024/0209726 A1 Jun. 27, 2024

(30) Foreign Application Priority Data

Mar. 11, 2020 (EP) ..... 20162420

(51) Int. Cl.
*E02D 5/00* (2006.01)
*E02D 5/36* (2006.01)
(Continued)

(52) U.S. Cl.
CPC ..... *E21B 47/06* (2013.01); *E02D 5/36* (2013.01); *E21B 11/04* (2020.05); *E21B 44/00* (2013.01);
(Continued)

(58) Field of Classification Search
CPC .... E02D 3/12; E02D 5/22; E02D 5/34; E02D 5/36; E02D 2250/0023; E02D 2300/0023; E02D 2600/10; E21D 47/06
See application file for complete search history.

(56) References Cited

U.S. PATENT DOCUMENTS 5,542,786 A * 8/1996 Blum ..... E02D 5/46 73/715
5,733,068 A * 3/1998 Reinert, Sr. ..... E02D 7/26 173/184
(Continued)

FOREIGN PATENT DOCUMENTS

CN 2791234 Y 6/2006
CN 201943581 U 8/2011
(Continued)

OTHER PUBLICATIONS

International Search Report issued in PCT/EP2021/051789; mailed Apr. 12, 2021.
(Continued)

*Primary Examiner* — Benjamin F Fiorello
(74) *Attorney, Agent, or Firm* — Studebaker & Brackett PC

(57) ABSTRACT

The invention relates to a soil working device for creating a substantially vertically running hole in the ground, which hole is provided with a slurry, said soil working device having a base body, a connection apparatus which is arranged on an upper end region of the base body, and a soil removal apparatus and/or a soil displacement apparatus, which is arranged on a lower end region of the base body. According to the invention is intended that, at a lower region of the base body, a first pressure measuring apparatus for measuring a first ambient pressure is arranged, and that at an upper region of the base body, which is vertically spaced apart from the lower region, a second pressure measuring
(Continued)

Figure 1:
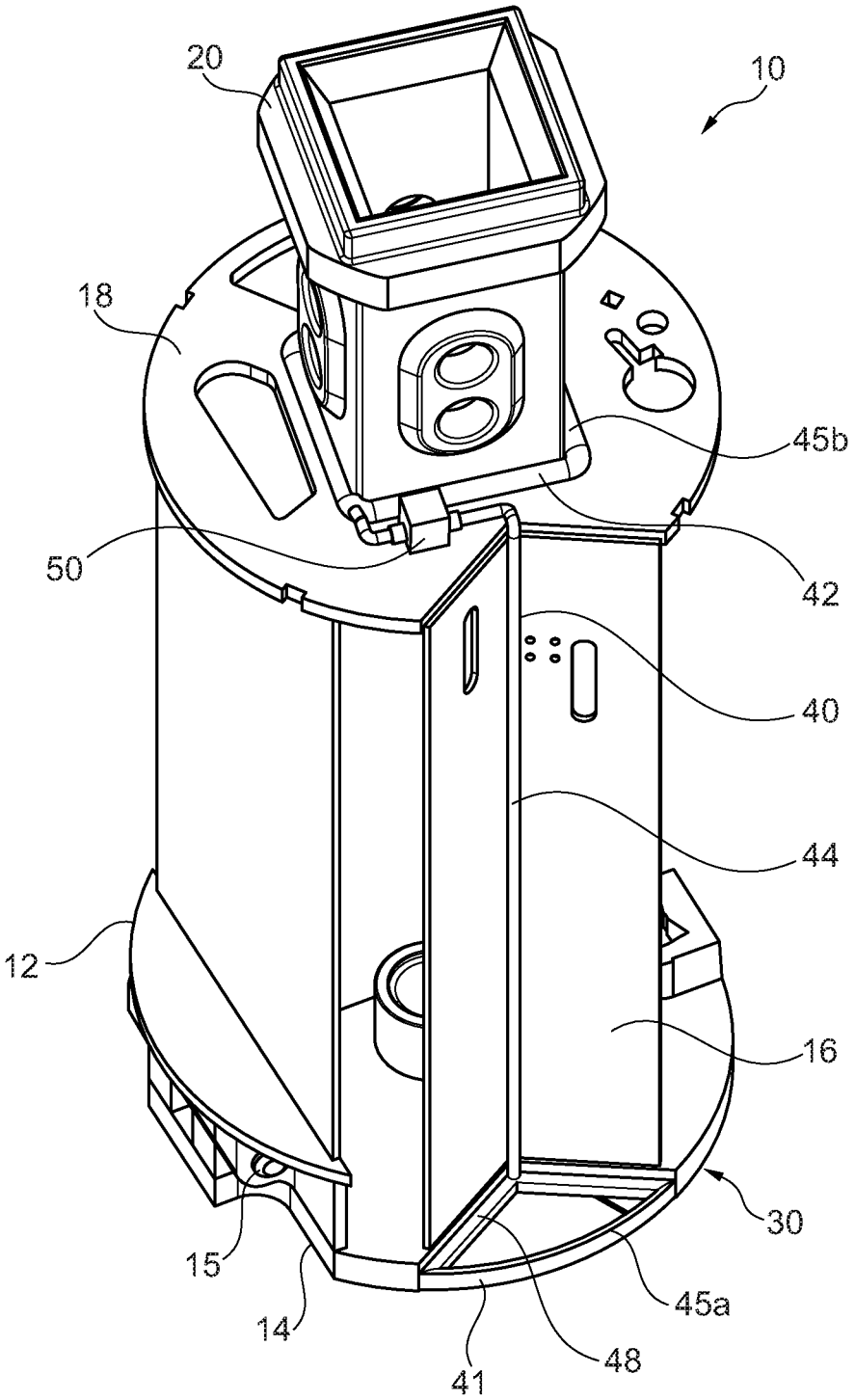

apparatus for measuring a second ambient pressure is arranged. The invention also comprises a method for creating a substantially vertical hole in the ground by means of such a soil working device.

13 Claims, 2 Drawing Sheets

(51) Int. Cl.
*E21B 11/04* (2006.01)
*E21B 44/00* (2006.01)
*E21B 47/06* (2012.01)

(52) U.S. Cl.
CPC ..... *E02D 2250/0023* (2013.01); *E02D 2300/0023* (2013.01); *E02D 2600/10* (2013.01)

(56) References Cited

U.S. PATENT DOCUMENTS 6,033,152 A * 3/2000 Blum ..... E21B 7/265 405/242
6,176,323 B1 * 1/2001 Weirich ..... E21B 44/005 175/40
7,404,449 B2 * 7/2008 Bermingham ..... E02D 13/06 173/128
7,621,098 B2 * 11/2009 Reinert, Sr. ..... E02D 5/803 52/742.1
7,987,904 B1 * 8/2011 Rose ..... E21B 33/03 52/220.8
10,640,945 B1 * 5/2020 Niroumand ..... E02D 5/44
2005/0100415 A1 * 5/2005 Larovere ..... E02D 13/06 405/252.1
2006/0213279 A1 * 9/2006 Choi ..... E02D 33/00 73/788
2010/0178115 A1 * 7/2010 McVay ..... E02D 5/44 405/231
2011/0243666 A1 * 10/2011 Fox ..... E02D 5/62 405/232
2012/0114423 A1 * 5/2012 Zago ..... E02D 7/20 405/230
2012/0308308 A1 * 12/2012 Stewart ..... E02D 27/00 405/229
2013/0269220 A1 10/2013 Matthias et al.

FOREIGN PATENT DOCUMENTS

DE 3440727 A1 5/1986
WO 9900575 A2 1/1999

OTHER PUBLICATIONS

International Preliminary Report on Patentability and Written Opinion issued in PCT/EP2021/051789; issued Sep. 6, 2022.
An Examination Report mailed by the Australian Patent Office on Sep. 12, 2023, which corresponds to Australian Patent Application 2021234003 and is related to U.S. Appl. No. 17/905,807.

* cited by examiner

SOIL WORKING DEVICE AND METHOD FOR CREATING A SUBSTANTIALLY VERTICAL HOLE IN THE GROUND

The invention relates to a soil working device for creating a substantially vertically running hole in the ground, which hole is provided with a slurry, having a base body, a connection apparatus which is arranged on an upper end region of the base body, and a soil removal apparatus and/or a soil displacement apparatus, which is arranged on a lower end region of the base body, according to the preamble of claim 1.

The invention also relates to a method for creating a substantially vertical hole in the ground by means of such a soil working device according to claim 13.

To create foundation piles in the ground, for example, it is known to create a hole in the ground using a soil working tool, such as a drilling bucket. Depending on the type of surrounding soil, the bore can be produced as a cased or uncased bore. In the case of an uncased bore, in particular, a slurry is to be provided which supports the borehole against collapse.

When a drilling bucket is used, discontinuous drilling is to be carried out. During drilling-out, the drilling bucket is filled with removed soil material until it is completely or at least largely filled. Then, the drilling bucket is to be drawn out of the hole filled with liquid, wherein above the surface, a drilling rig pivots to an emptying position at which the drilling bucket can be emptied. The drilling bucket is then pivoted back and reintro-duced into the borehole to perform a further drilling step.

During the creation of a hole in the ground which is filled with a slurry, there is the problem that when the soil working device is retracted, a negative pressure can form under the soil working device in the hole. If this negative pressure becomes too great, soil material can fall from the side walls into the hole. This fallen-in soil material does not merely mean additional work for retrieving it from the hole. Rather, a collapse of this kind poses the risk of a ground failure, wherein as a result of the material which has fallen into the hole, the surrounding ground is weakened and destabilised such that larger settlement movements occur in the region surrounding the hole. This can damage existing structures or cause construction machines to topple over. A ground failure constitutes a significant danger for people and objects, so that comprehensive preventive measures must be taken against such a ground failure.

To avoid such a risk through the formation of a negative pressure under a soil working device during upward drawing, it is known to keep the retraction speed of the soil working tool low, so that a sufficient pressure compensation between the top side and the bottom side of the soil working device can take place in the hole.

Furthermore, during a discontinuous method for creating a hole for example with a drilling bucket, there is the problem that a correct filling of the drilling bucket is simply difficult to control, because during drilling into the ground, the removed soil material often has a different volume from the firm contiguous soil.

If a drilling bucket is not sufficiently filled during a drilling step, additional drilling steps are required. This results in additional expenditure of time and costs. If, on the other hand, the drilling bucket is overfilled, the soil material in the drilling bucket can become so strongly compressed that it does not fall out of the drilling bucket by itself when emptying by opening the base. Then, additional manual operations are needed to empty and clean the drilling bucket. This also results in additional expenditure of time and costs.

The object underlying the invention is to specify a soil working device and a method with which a hole can be created in the ground in a particularly efficient manner.

The object is solved on the one hand by a soil working device having the features of claim 1 and on the other hand by a method having the features of claim 13. Preferred embodiments of the invention are specified in the dependent claims.

The soil working device according to the invention is characterised in that at a lower region of the base body, a first pressure measuring apparatus for measuring a first ambient pressure is arranged, and that at an upper region of the base body, which is vertically spaced apart from the lower region, a second pressure measuring apparatus for measuring a second ambient pressure is arranged.

A fundamental concept of the invention can be considered in that to provide at least two pressure measuring apparatuses on a basic body of a soil working device. The pressure measuring apparatuses are arranged such that they are located at a lower region of the basic body and at an upper region of the base body in the borehole. In this manner, a first ambient pressure can be measured in a lower region of the basic body and spaced apart therefrom a second ambient pressure can be measured at an upper region of the basic body in the borehole. Because of the fixed spacing of the two pressure measuring apparatuses, there must, in a comparison of the two measured ambient pressures, result a substantially constant pressure difference, which depends on the consistency of the slurry. Deviations from this pressure difference or between the measurements of the two pressure measuring apparatuses enable statements to be made for example about the fact that a negative pressure is forming under the soil working device or a filling of the basic body is increasing or decreasing. The values or data of the pressure measuring apparatuses can therefore be used for a safe and efficient operation of the soil working device.

In principle, the pressure measuring apparatuses can be configured in any manner, for example as electronic pressure sensors. A preferred embodiment of the invention exist in that the first pressure measuring apparatus and/or the second pressure measuring apparatus have at least one hollow measuring body which is filled with a measuring fluid. The measuring body can be here a tubular body or a measuring body composed of tubular bodies. A liquid or a gas can be provided as measuring fluid. Water or an oil is preferably used as measuring fluid. With the measuring fluid, one or more sensor apparatuses can thus be connected in a protected manner.

According to a development of the invention, a particularly good pressure measurement can be achieved in that the measuring body has at least one flexible measuring surface which is in contact with the environment. The measuring surface can be a foil, membrane or fluid-tight fabric through which an outside ambient pressure can be transferred through the slurry or the soil material to the measuring fluid. The measuring surface can optionally be protected by a protective apparatus, optionally a protective sleeve having a perforation, for example by a grille.

Basically, the measuring body can be designed as any hollow body. It is particularly efficient for the measuring body to be designed tubular. The measuring body can thereby be produced from tubular standard materials. The tubular measuring body can have a toroidal cross section or a square or other polygonal cross section.

For a particularly meaningful pressure measurement at a height range of the soil working tool it is advantageous, according to a development of the invention, that the measuring body is arranged substantially horizontally. The measuring body can preferably extend horizontally partially or totaling around the circumference of the soil working device so that a reliable pressure measurement can take place. Horizontally within the context of the invention means an orientation approximately perpendicular to the lon-gitudinal axis of the soil working tool and to the drilling direction.

In principle, the invention can be implemented by two or more separate pressure measuring apparatuses which can also have electronic sensors. According to an embodiment variant of the invention, a particularly efficient measuring arrangement is in that the first pressure measuring apparatus and the second pressure measuring apparatus are in fluidic connection by means of a connection line, and that a sensor apparatus is arranged on the connection line, with which sensor apparatus a pressure difference between a first pressure at the first pressure measuring device and a second pressure at the second pressure measuring device can be sensed. The pressure difference can be sensed alternatively to or, preferably, in addition to the two individual pressure measurements. A direct measuring of a pressure difference permits a particularly reliable statement to be made as to whether, for example, a negative pressure is building up at the lower end of the soil working device, as can occur for example if the soil working device is drawn out of the hole too quickly.

The soil working device can in principle be designed in any manner. According to a development of the invention, it is preferred that the soil working device is designed as a removal-type drilling tool, a displacement-type drilling tool or a trench wall cutter. A removal-type drilling tool has, on its underside, material-removing removal elements, such as cutting teeth, chisels or roller bits. The drilling tool can be a drilling bucket, an auger or more particularly another discontinuously operating drilling tool. The soil working device can also be designed as a displacement-type drilling tool. Though, a dis-placement-type drilling tool has at least one displacement surface which, with a rotating drive, displaces genuine or removed soil material substantially radially into the borehole wall. A combination of removal-type and displacement-type tool can also be provided. Furthermore, the soil working device can also be a trench wall cutter which has at least one or preferably a plurality of cutting wheels at the lower end, which are driven rotationally about rotational axes directed transverse to the advancing direction.

By means of a trench wall cutter, a hole or cut trench with a polygonal cross section can also be created. When a trench wall cutter is drawn, there is basically also the risk of a ground failure if drawing is carried out too quickly without sufficient pressure compensation between the top side and the bottom side of the trench wall cutter.

The invention further comprises a soil working implement which, in order to create a hole in the ground, is provided with the above-mentioned soil working device, which is arranged in a vertically adjustable and drivable manner.

Preferably, such a soil working implement has a carrier unit having an upper carriage which is rotationally mounted on a mobile undercarriage. The undercarriage can, in particular, have a track laying arrangement. The soil working implement can, in particular, be a drilling rig or a trench wall cutting device having a carrier unit. On the upper carriage, a substantially vertically directed mast is preferably arranged, along which the soil working device is mounted in a vertically adjustable manner.

According to a development of the invention, it is preferred that a control unit is provided that has a data connection to the first pressure measuring apparatus, the second pressure measuring apparatus and/or the sensor apparatus. The control unit can thereby document pressure curves and/or, depending on the ascertained values and data, control the working implement.

Here, it is particularly preferably that the control unit is configured to control a vertical movement and/or a rotational drive of the soil working device depending on data which are transmitted by the first pressure measuring apparatus, the second pressure measuring apparatus and/or the sensor apparatus. If, for example, an increase in the pressure difference between the two pressure measuring apparatuses is identified, this may be an indication that a negative pressure is building up at the soil working device. In this case, a vertical movement, for example when the device is being drawn out of the hole, can be stopped or reduced as far as a pressure difference below a specified limit value is triggered again. Similarly, a rotational drive, for example on a drilling rig or a rotational drive on cutting wheels can be changed depending on the pressure values, wherein pressure values can for example be a measure for it, how much soil material is being removed, and, more particularly, whether too much or too little soil material is being removed.

A further preferred embodiment variant of the soil working implement according to the invention can be exist in that the control unit is configured to determine a filling level based on the data about the pressure at the soil working device. If, for a drilling bucket, the filling of the drilling bucket with fill material increases, for example, this can be identified by the ascertained pressure values, particularly at the lower first pressure measuring apparatus. Basically, the pressure at the lower pressure measuring apparatus increases as the filling level increases, and thus as the loading of removed soil material increases.

If a particular limit value is reached here, this can be considered an indication therefor that a sufficient filling level for a drilling bucket has been reached. Alternatively or ad-ditionally, in the event of a complete filling of a drilling bucket while the drilling drive continues to run, it can be identified that there results no change, or a different change, in the pressure difference between the two pressure measuring apparatuses. This can be seen as an indication therefor that a particular complete filling level is given for a soil working device having a receiving space.

In the method according to the invention it is provided that the hole is filled with a slurry during its creation, and by means of the first pressure measuring apparatus, a first ambient pressure in a lower region of the soil working device is measured and by means of the second pressure measuring apparatus, a second ambient pressure in an upper region of the soil working device is measured. The method according to the invention can, in particular, be executed using the above-described soil working device or with the above-described soil working implement. The above-described advantages can thereby be achieved.

An advantageous variant of the method exists in that the first pressure measuring apparatus is fluidically connected to the second pressure measuring apparatus by means of a connection line, and that a sensor apparatus is arranged on the connection line, with which sensor apparatus a pressure difference between a first pressure at the first pressure measuring device and a second pressure at the second pressure measuring device can be sensed. Here, by means of the sensor apparatus, a pressure difference between the two pressure measuring apparatuses can be directly sensed in an efficient manner.

Figure 2:
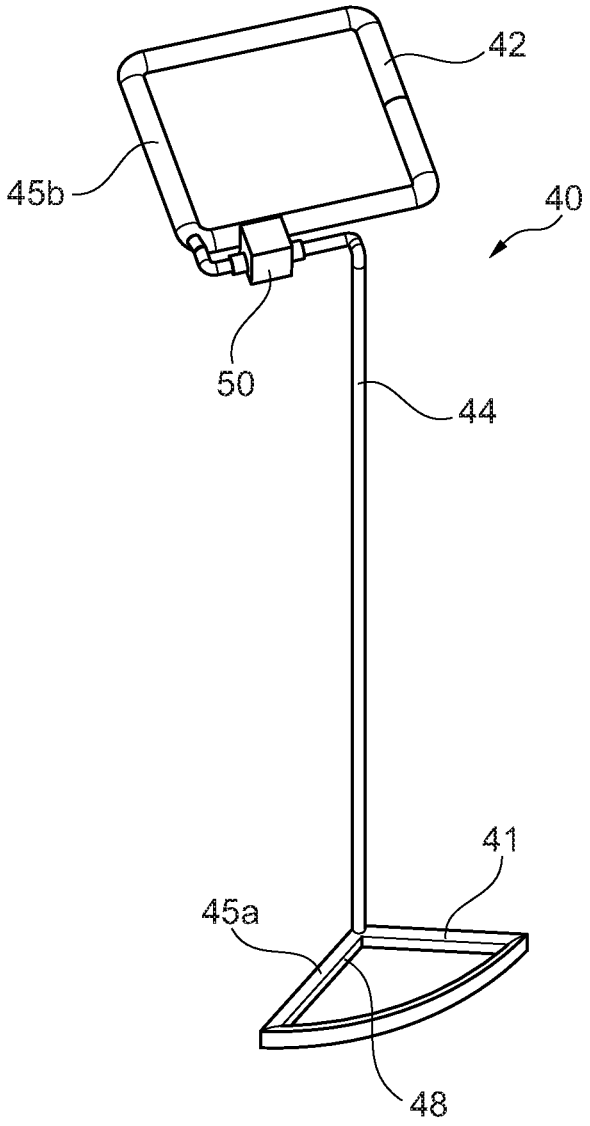

The invention is hereinafter described on the basis of a preferred exemplary embodiment, which is schematically depicted in the attached drawings. The drawings show:

FIG. 1 a perspective view of part of a soil working device according to the invention; and FIG. 2 a detail of the soil working device of FIG. 1 relating to a pressure measuring arrangement.

A soil working device 10 according to the invention, which is designed as a drilling bucket, is explained in connection with FIGS. 1 and 2. For reasons of clarity, a tubular housing, which surrounds a basic body 12, has been omitted from the soil working device 10. At the bottom side of the basic body 12, a base 14 is arranged, which has, on its bottom side, a soil removal apparatus 30. Via an opening, not shown, in the base, removed soil material can be received in an inner receiving space on the basic body 12. The base 14 is mounted pivotable about a horizontally oriented pivot axis 15. Thus, the base 14 can be pivoted open downwardly to empty the drilling bucket.

The housing around the basic body 12 is covered towards the top by a cover plate 18 on which a connection apparatus 20 is attached for connection to a drill pipe. In the shown exemplary embodiment, the connection apparatus 20 is designed as a so-called Kelly box, which can receive a square-shaped end of a drill pipe. A drill pipe can thus be received and secured torque proof in the sleeve-like connection apparatus 20 by means of transversely oriented locking bolts.

According to the invention, the soil working device 10 is provided with a pressure measuring arrangement 40 which has a first pressure measuring apparatus 41 at a lower region of the base body 12 and a second pressure measuring apparatus 42 at an upper region of the basic body 12. The lower first pressure measuring apparatus 41 has a first hollow measuring body 45*a* which is constructed annularly from three tubular elements. The outer measuring element pointing outwards is designed in an arc-shaped manner corresponding to an outer circumferential radius of the basic body 12. In particular, at an inner side of the first hollow measuring body 45*a*, a flexible measuring surface 48 can be arranged which, corresponding to an external pressure, possibly deforms with removed soil material as a result of slurry in situ, and thus transfers an external pressure to an inner measuring fluid.

The first hollow measuring body 45*a* is designed parallel to the horizontal base 14 and can be in contact, via a recess in the base 14, with an outer side or an external environment. A corresponding recess is also formed in the cover plate 18, wherein a chan-nel 17 is formed through an inner wall 16 along the basic body 12, through which sus-pension as slurry can flow along the basic body 12.

The upper second pressure measuring apparatus 42 has a second annular hollow measuring body 45*b* which is formed from four tubular elements. The second hollow measuring body 45*b* extends here annularly around the connection apparatus 20 at the top side of the cover plate 18. The second hollow measuring body 45*b* is also designed with a flexible measuring surface for sensing an external ambient pressure, wherein the ambient pressure can be transferred to an inner measuring fluid.

The first pressure measuring apparatus 41 and the second pressure measuring apparatus 42 are fluidically connected by means of a connection line 44 which extends axially along the basic body 12. To protect the connection line 44, the inner wall 16 is provided, which largely delimits and protects the connection line 44 and also the first pressure measuring apparatus 41 on the base 14 from removed soil material in the interior of the basic body 12. On the cover plate 18, a sensor apparatus 50 is connected at the connection line 44, with which sensor apparatus a pressure difference between the first pressure measuring apparatus 41 and the second pressure measuring apparatus 42 can be identified.

The sensor apparatus 50 can have a conventional pressure sensor or also a flowmeter which identifies a movement of the measuring fluid in the pressure measuring arrangement 40 due to different pressures at the first measuring apparatus 41 and the second measuring apparatus 42. Furthermore, pressure sensors can be arranged at each of the two pressure measuring apparatuses 41, 42, with which pressure sensors a re-spective absolute pressure can be ascertained. The sensor apparatus 50 and the further sensors are connected to a control unit of a soil working implement, not shown, wherein corresponding to the ascertained pressure values, the control unit controls a vertical movement of the soil working device 10 and/or a rotational drive for rotating the soil working device 10.

In the exemplary embodiment shown, the pressure measuring apparatuses 41, 42 are arranged on an outer side. If a sensing of the filling level is desired, the first pressure measuring apparatus 41 can be arranged in the internal receiving space of the basic body 12.

The invention claimed is:

1. A soil working device for creating a substantially vertically running hole in the ground, which hole is provided with a slurry, said soil working device having a basic body, a connection apparatus which is arranged at an upper end region of the basic body, and a soil removal apparatus and/or a soil displacement apparatus which is arranged at a lower end region of the basic body, wherein at a lower region of the basic body a first pressure measuring apparatus for measuring a first ambient pressure is arranged, at an upper region of the basic body, which is vertically spaced apart from the lower region, a second pressure measuring apparatus for measuring a second ambient pressure is arranged, the first pressure measuring apparatus and the second pressure measuring apparatus are in fluidic connection by means of a connection line, and a sensor apparatus is arranged on the connection line, with which sensor apparatus a pressure difference between a first pressure at the first pressure measuring apparatus and a second pressure at the second pressure measuring apparatus can be sensed.

2. The soil working device according to claim 1, wherein the first pressure measuring apparatus and/or the second pressure measuring apparatus comprise at least one hollow measuring body which is filled with a measuring fluid.

3. The soil working device according to claim 2, wherein the measuring body comprises at least one flexible measuring surface that is in contact with the environment.

4. The soil working device according to claim 2, wherein the measuring body is of tubular configuration.

5. The soil working device according to claim 2, wherein the measuring body is arranged substantially horizontally.

6. The soil working device according to claim 1, wherein the soil working device is designed as a removal-type drilling tool, a displacement-type drilling tool or a trench wall cutter.

7. A soil working implement, wherein to create a hole in the ground, a soil working device according to claim 1 is arranged in a vertically adjustable and drivable manner.

8. The soil working implement according to claim 7, wherein a control unit is provided which has a data connection to the first pressure measuring apparatus, the second pressure measuring apparatus and/or the sensor apparatus.

9. The soil working implement according to claim 8, wherein the control unit is configured to control a vertical movement and/or a rotational drive of the soil working device depending on data which are transmitted from the first pressure measuring apparatus, the second pressure measuring apparatus and/or the sensor apparatus.

10. The soil working implement according to claim 8, wherein the control unit is configured to determine a filling level based on the data about the pressure at the soil working device.

11. A method for creating a substantially vertical hole in the ground by means of a soil working device according to claim 1, wherein the hole is filled with a slurry during creation, and by means of the first pressure measuring apparatus, a first ambient pressure in a lower region of the soil working device is measured and by means of the second pressure measuring apparatus, a second ambient pressure in an upper region of the soil working device is measured.

12. A soil working device for creating a substantially vertically running hole in the ground, which hole is provided with a slurry, said soil working device having a basic body, a connection apparatus which is arranged at an upper end region of the basic body, and a soil removal apparatus and/or a soil displacement apparatus which is arranged at a lower end region of the basic body, wherein at a lower region of the basic body a first pressure measuring apparatus for measuring a first ambient pressure is arranged, at an upper region of the basic body, which is vertically spaced apart from the lower region, a second pressure measuring apparatus for measuring a second ambient pressure is arranged, the first pressure measuring apparatus and/or the second pressure measuring apparatus comprise at least one hollow measuring body which is filled with a measuring fluid, and the measuring body is arranged substantially horizontally.

13. A method for creating a substantially vertical hole in the ground by means of a soil working device having a basic body, a connection apparatus which is arranged at an upper end region of the basic body, and a soil removal apparatus and/or a soil displacement apparatus arranged at a lower end region of the basic body, wherein at a lower region of the basic body a first pressure measuring apparatus for measuring a first ambient pressure is arranged, and at an upper region of the basic body, which is vertically spaced apart from the lower region, a second pressure measuring apparatus for measuring a second ambient pressure is arranged;

wherein the hole is filled with a slurry during creation, and by means of the first pressure measuring apparatus, a first ambient pressure in a lower region of the soil working device is measured and by means of the second pressure measuring apparatus, a second ambient pressure in an upper region of the soil working device is measured, the first pressure measuring apparatus is fluidically connected to the second pressure measuring apparatus by means of a connection line, and a sensor apparatus is arranged on the connection line, with which sensor apparatus a pressure difference between a first pressure at the first pressure measuring apparatus and a second pressure at the second pressure measuring apparatus is sensed.

* * * * *